US005718178A

United States Patent [19]

Smith

[11] Patent Number: 5,718,178

[45] Date of Patent: Feb. 17, 1998

[54] STORAGE TABLE AND PLANTER COMBINATION

[76] Inventor: Thom A. Smith, 2545-A Royal County Down, Uniontown, Ohio 44685

[21] Appl. No.: 774,037

[22] Filed: Dec. 27, 1996

[51] Int. Cl.[6] ..... A47B 85/00

[52] U.S. Cl. ..... 108/25; 108/13; 297/198; 297/188.09

[58] Field of Search ..... 108/26, 25, 13, 108/157, 11, 14, 24, 33, 34, 37, 50, 150; 297/188.09, 217.1, 451.6

[56] References Cited

U.S. PATENT DOCUMENTS

| | | | |
|---|---|---|---|
| 2,107,010 | 2/1938 | McDonald | 108/150 X |
| 3,751,845 | 8/1973 | Van Leauwen | 297/188.09 X |
| 4,242,971 | 1/1981 | Kleinman | 108/26 |
| 4,295,680 | 10/1981 | Grasso | 297/188.09 |
| 4,428,305 | 1/1984 | Creske | 108/33 X |
| 4,760,802 | 8/1988 | Leong | 108/157 |
| 5,171,060 | 12/1992 | Kaye | 108/150 X |
| 5,403,079 | 4/1995 | Festisoff | 108/25 X |
| 5,577,344 | 11/1996 | Zaremba et al. | 108/150 X |
| 5,582,471 | 12/1996 | Lin | 197/25 X |

FOREIGN PATENT DOCUMENTS

| | | | |
|---|---|---|---|
| 47821 | 10/1933 | Denmark | 108/25 |
| 1522364 | 8/1978 | United Kingdom | 108/26 |

*Primary Examiner*—Jose V. Chen

*Attorney, Agent, or Firm*—Renner, Kenner, Greive, Bobak, Taylor & Weber

[57] ABSTRACT

A combination storage table and planter has a tubular body extending upwardly from a base. Received within the tubular body is an open ended spool. A reversible top is adapted to be received upon the tubular member such that in one orientation a table having a substantially flat planar surface is defined, and in another orientation the top has a recess or cavity for receiving soil and plants. The storage compartments are separated for dry and wet storage. Accordingly, a storage unit is provided which may also alternatively function as either a table or a plantar.

16 Claims, 2 Drawing Sheets

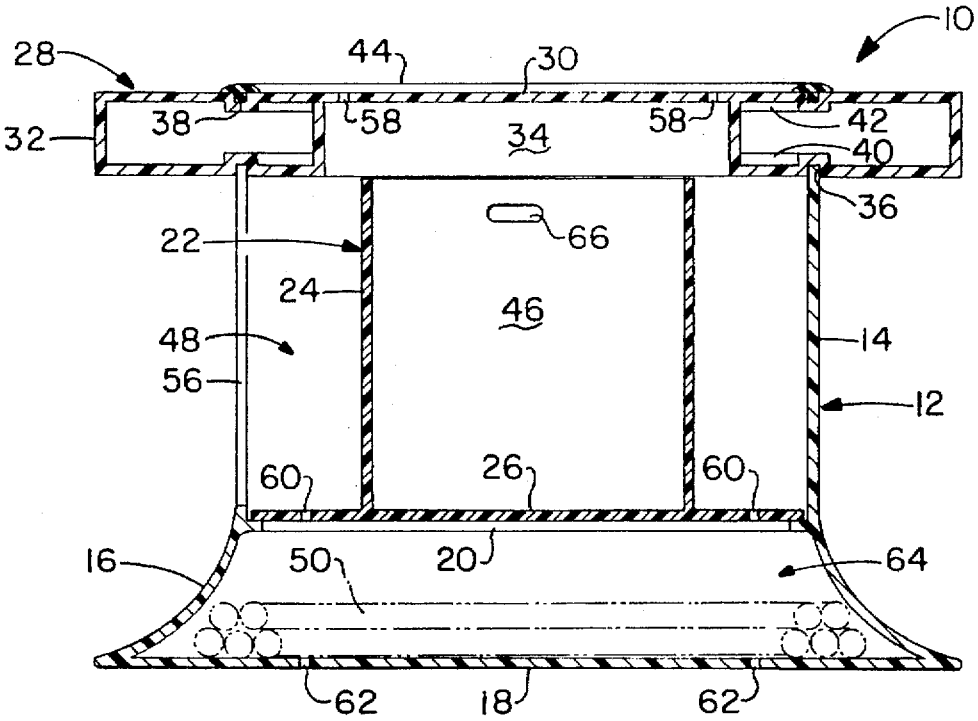
FIG.-3
FIG.-4
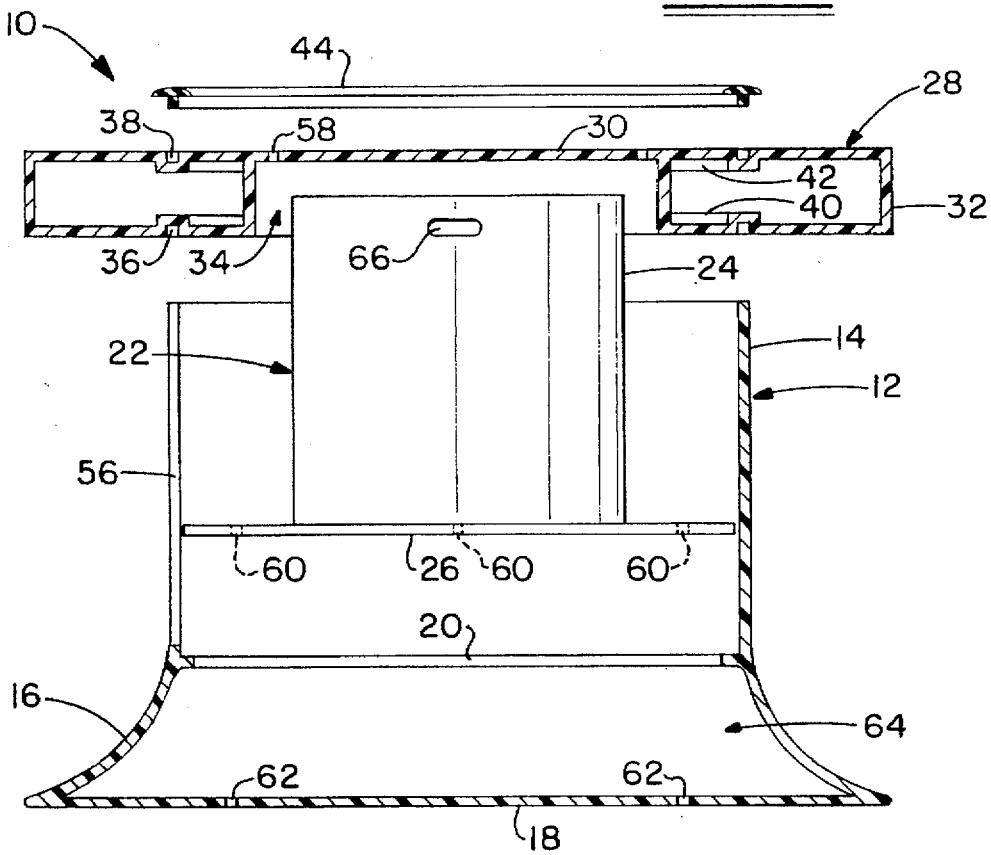

STORAGE TABLE AND PLANTER COMBINATION

TECHNICAL FIELD

The invention herein resides in the art of storage devices and, more particularly, to such storage devices for outdoor residential use. The invention pertains to a storage device which performs functions apart from the storage of materials and implements. Specifically, the invention relates to a storage device which can also selectively serve as a planter or table.

BACKGROUND ART

The landscaping of most residences requires a water hose, garden tools, fertilizers and like for ready accessibility to maintain the landscaping in proper order. Typically, such materials are stored in a garage or a shed where space is scarce. Moreover, such storage areas are often a distance from the area of need such as a patio, deck, or the like. Accordingly, the time to retrieve and/or replace the material is bothersome, often resulting in the material not being used or replaced.

It is most desirable to provide storage for basic landscaping maintenance devices and materials at an area proximate to the area of use. It is further desirable that such storage facility conceal the stored materials or articles and that it serve a purpose in addition to that of storage.

It has been previously known to provide a tool caddie and stool combination for storing various hand and power tools for easy access. See U.S. Pat. No. 4,458,963. A portable nestable storage bin having drainage apertures in the bottom thereof has also been previously known from U.S. Pat. No. 4,200,346. A combination table and bar cabinet having a storage unit is known from U.S. Pat. No. 3,695,742, while U.S. Pat. No. 2,871,057 presents a hose basket and U.S. Pat. No. 4,744,613 discloses a combination tool box and stool which provides compartmentalized storage.

The foregoing prior art is unsuitable for implementation in accordance with the concept of the invention which is particularly adapted for use on residential patios and decks. Often, these areas accommodate tables and/or planters, serving both utilitarian and aesthetic functions. In accordance with the invention, it is most desirable to devise a storage unit which can serve not only to store materials and devices, but which can also serve selectively as a storage table or planter.

DISCLOSURE OF INVENTION

In light of the foregoing, it is a first aspect of the invention to provide a storage unit which serves additional utilitarian functions.

Another aspect of the invention is to provide a storage unit which can serve as a table.

Another aspect of the invention is to provide a storage unit which can serve as a planter.

A further aspect of the invention is to provide a storage unit which can selectively serve as either a table or a planter.

Still another aspect of the invention is the provision of a storage unit which is reliable and durable in use, easily constructed from state of the art materials, and conducive to implementation in a wide variety of environments.

The foregoing and other aspects of the invention which will become apparent as the detailed description proceeds are achieved by a storage unit, comprising: a base member; a hollow body member extending upwardly from said base member; and a top removably received by said hollow body member at an end thereof opposite said base, said top being reversible in its orientation of reception by said hollow body member, said top defining a substantially planar table top surface in a first orientation of reception, and said top defining a receptacle in a second orientation of reception.

Other aspects of the invention which will become apparent herein are achieved by a convertible storage unit, comprising: a base; a tubular body member extending upwardly from said base; a top having first and second parallel sides, said top having means on each said side for engagingly receiving said tubular body member; and divider means receiving with said tubular body member for defining plural storage compartments within said tubular body member.

BRIEF DESCRIPTION OF THE DRAWINGS

For a complete understanding of the objects, techniques, and structure of the invention reference should be made to the following detailed description and accompanying drawings wherein:

FIG. 3 is a cross section of the storage table and planter combination of the invention shown in the table configuration; and FIG. 4 is an assembly diagram showing the various pans of the invention in relationship to each other in the table configuration.

BEST MODE FOR CARRYING OUT THE INVENTION

Figure 1:
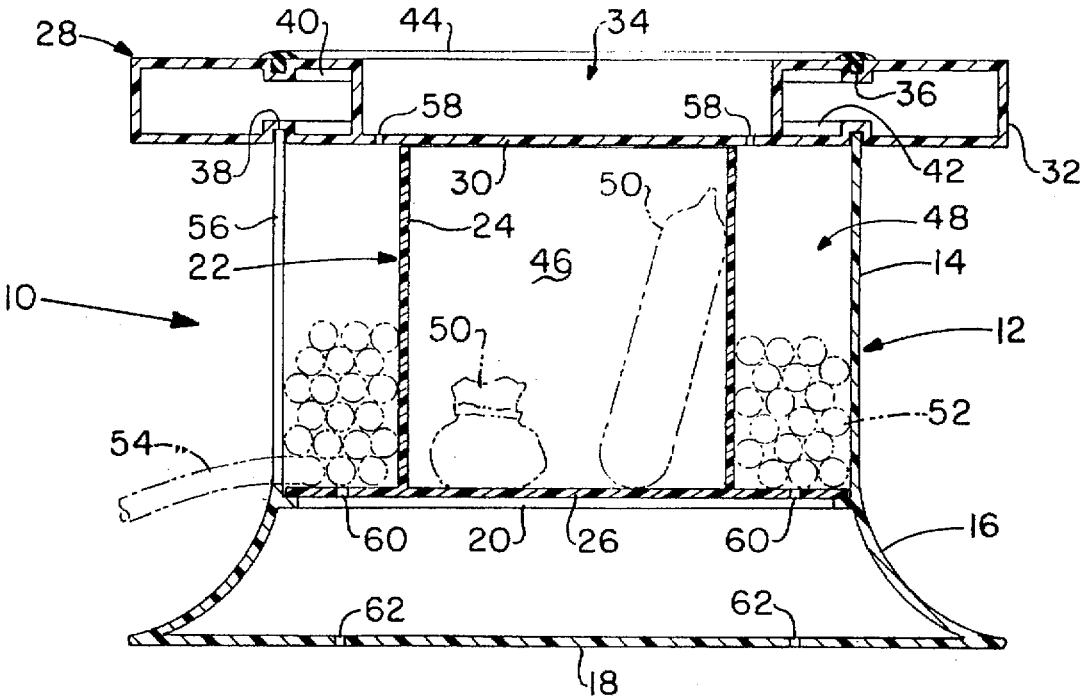
FIG. 1 is a cross sectional view of the storage table and planter combination of the invention.
Figure 2:
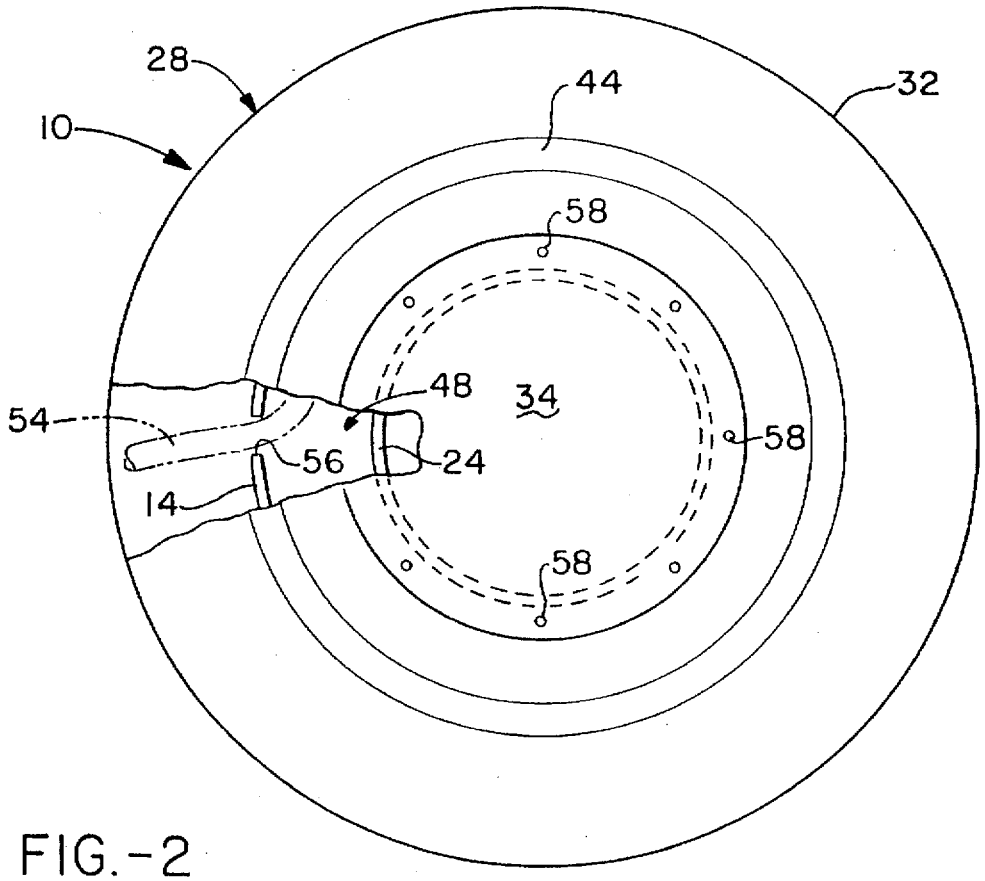
FIG. 2 is a top plan view, partially broken away, of the structure of FIG. 1.

Referring now to the drawings and more particularly FIGS. 1 and 2, it can be seen that a storage unit made in accordance with the invention is designated generally by the numeral 10. As will become apparent herein, the storage unit 10 is adapted to selectively serve as a table or a planter in combination with its storage functions. The storage unit 10 includes a base and body member 12 consisting of a cylindrical or tubular body portion 14 open at the top end thereof, and a flared out base member 16 having a circular concave side, as shown. A bottom plate 18 is received at the bottom of the base 16 and encloses the same. While it will be appreciated that the bottom plate 18 is optional, its provision does add strength and integrity to the entire unit, while also serving to close the bottom of the base.

A rim or support flange 20 is circumferentially positioned about the interior of the base and body member 12 at an area substantially intermediate the body portion 14 and base member 16. The support flange 20 extends inwardly into the cavity so defined. An open ended spool 22 is removable received upon and supported by the flange 20, as shown. The spool 22 includes a cylindrical body 24 having a circular base plate 26 connected to one end thereof and extending outwardly therefrom, as illustrated. The diameter of the circular base plate 26 is approximately equal to, but slightly less than, the inside diameter of the cylindrical body portion 14 to accomodate removal and replacement of the spool 22. The outer circumferential portion of the base plate 26 is in engagement with the rim or support flange 20, as illustrated.

A reversible top 28 is received upon and supported by the cylindrical body portion 14 and, in the arrangement shown in FIGS. 1 and 2, by cylindrical body 24 of the spool 22. In other words, the reversible top 28 is supported by the open ends of the cylindrical members 14, 24. The top 28 is substantially disk shaped, as shown.

A circular plate 30 defines one surface of the top assembly 28 which is encompassed about a circumference by a ring 32 of rectangular cross section. The ring 32 further encircles and defines a cylindrical recess or cavity 34 which is closed at one end by the circular plate 30 and opened at the opposite end. Circular grooves or channels 36, 38 are defined on opposite parallel sides of the ring 32. In a preferred embodiment of the invention, the grooves or channels 36, 38 are maintained in respective circular ribs 40, 42 defined on the opposite inner surfaces of ring 32.

As illustrated in FIG. 1, the top 28 is oriented such that the circular groove 38 receives the top circular edge of the cylindrical body portion 14 to provide a planter arrangement. In such an orientation, a decorative ring 44 may be placed in and received by the channel 36 to close and conceal the channel 36 in a fashionable way. The cavity 34 opens upwardly such that the storage unit 10 may serve as a planter. Soil and plants may then be appropriately placed in the cavity 34, as desired. Preferably, and for added support, the cylindrical body portion 14 extends above the cylindrical body member 24 a distance substantially equal to the depth of the groove 38 such that, in the planter orientation, the top circular surface at the open end of the cylindrical body 24 also engages and supports the circular plate 30.

It will be appreciated by those skilled in the art that the structure just defined can readily be configured from plastic parts appropriately molded and fitted together. Additionally, and as is readily appreciated by viewing the drawings, such a structure is of substantial integrity.

With further reference to FIGS. 1 and 2, it can be seen that a cylindrical cavity 46 is defined within the cylindrical body 24 of the spool 22. That cavity is closed by the top 28 and the circular base plate 26. A second ring-like cavity 48 is defined between the cylindrical members 14, 24 and between the base plate 26 and top assembly 28. In accordance with the invention, items which are preferably kept dry, such as fertilizer, potting soil, implements, and the like, designated generally by the numeral 50, may be maintained within the cavity 46. A hose 52 may be coiled or wrapped about the cylindrical body 24 of the spool 22 within the cavity 48. This cavity defines "wet" storage in contradistinction to the "dry" storage of the cavity 46. The end 54 of the hose 52 passes through a vertical slot 56 in the cylindrical body portion 14 and may extend therefrom to a faucet or spigot, where it may be substantially continually attached.

Drainage holes 58 are provided in the circular plate 30, as are drainage holes 60 in the circular base plate 26, and drainage holes 62 in the bottom plate 18. The drainage holes 58 allow for water to drain from the planter receptacle or cavity 34, through the compartment 48, through the drainage holes 60, and out of the draining holes 62. In similar fashion, the water from hose 52 may drain through the drainage holes 60, 62.

In use, one removes the top 28 and exposes the cavities 46, 48 for placing items or implements 50, 52 therein. The slot 56 accommodates placement of the end 54 of the hose 52 as should be apparent to those skilled in the art. With all of the drainage holes 58, 60, 62 being outside the perimeter of the compartment 46, that compartment remains dry. After the articles or items 50, 52 are placed in their appropriate storage compartments 46, 48, the top assembly 28 may be replaced.

With reference now to FIG. 3, the storage unit 10 can be seen wherein the reversible top 28 is oriented to configure the unit into a table. In this instance, the grooves or channels 36 are engaged by the circular top edge of the cylindrical body portion 14, such that the continuous circular plate 30 defines a table top. The decorative ring 44 is placed into and conceals the groove or channel 38. In this situation, the top edge of the cylindrical body 24 of the spool 22 does not engage the top assembly 28, but is maintained beneath the inverted cavity 34.

With further reference to FIG. 3, it can be seen that a cavity 64 is defined within the base 16 between the bottom plate 18 and the circular base plate 26. Additional wet storage may be accomplished in the cavity 64. For instance, the hose 50 may be stored therein, as illustrated. Access to the storage area 64 is easily achieved by removing the top 28 and then removing the open ended spool 22.

With reference now to FIG. 4, the various elements of the storage unit 10 can be seen in separated fashion for implementation as a storage table. It will readily be appreciated that the decorative ring 44 may be placed into either of the circular grooves or channels 36, 38, depending upon the orientation of the top 28. That orientation determines whether the unit 10 is employed as a storage table or a storage planter. Additionally, it can be seen that the open ended spool assembly 22 is easily removed from and placed into the cylinder defined by the cylindrical body portion 14. The circular base plate 26 is received upon and supported by the rim or support flange 20. The flared out base member 16 provides not only an aesthetically pleasing appearance, but also adds to rigidity and stability of the unit 10.

Moreover, and as can be seen in FIG. 4, the body 24 of the spool 22 may include a pair of diametrically disposed handle apertures 66 formed therein. Such handles facilitate removal and replacement of the spool 22 as desired.

Thus it can be seen that the objects of the invention have been achieved by the structure presented and discussed above. A storage unit provides multiple compartments for wet or dry storage, and in which the unit itself may additionally serve the function of a table or planter. The system may readily be manufactured from wood or metal, although plastic is preferred.

While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A storage unit, comprising:

a base member;

a hollow body member extending upwardly from said base member;

a top removably received by said hollow body member at an end thereof opposite said base, said top being reversible in its orientation of reception by said hollow body member, said top defining a substantially planar table top surface in a first orientation of reception, and said top defining a receptacle in a second orientation of reception; and a spool received within and supported by said body member above said base member, said spool being maintained in spaced apart relationship with said body member and said base member and thereby defining a plurality of storage areas within said body member and said base member.

2. The storage unit according to claim 1, wherein said spool comprises a cylindrical body member connected to a circular base plate.

3. The storage unit according to claim 2, wherein said body member has a rim extending inwardly about the circumference thereof, said rim receiving and supporting said circular base plate of said spool.

4. The storage unit according to claim 3, wherein a first storage area is defined within said body member of said spool and between said top and said base plate of said spool.

5. The storage unit according to claim 4, wherein a third storage area is defined between said base member and said base plate of said spool.

6. The storage unit according to claim 4, wherein a second storage area is ring-shaped, and defined between said body member of said spool, said hollow body member, and said base plate of said spool.

7. The storage unit according to claim 6, wherein said top and circular base plate have drainage holes therein.

8. The storage unit according to claim 7, wherein said drainage holes communicate with said ring-shaped storage area.

9. The storage unit according to claim 1, wherein said receptacle in said top is defined by an encompassing ring of rectangular cross section.

10. The storage unit according to claim 9, wherein said ring includes a pair of circular channels on opposite sides thereof, each of said channels being configured to receive said hollow body member.

11. The storage unit according to claim 10, further comprising a decorative ring configured to engage each of said channels.

12. The storage unit according to claim 11, wherein one of said circular channels receives said hollow body member and the other of said circular channels receives said decorative ring.

13. The storage unit according to claim 10, wherein said receptacle defines a planter for receiving soil and plants.

14. A convertible storage unit, comprising:

a base;

a tubular body member extending upwardly from said base, said tubular body member having an axial slot therein extending substantially the length thereof;

a top having first and second parallel sides, wherein said first side of said top is substantially planar, and said second side contains a receptacle defined by an encompassing ring, said top having means on each said side for engagingly receiving said tubular body member; and divider means received within said tubular body member for defining plural storage compartments within said tubular body member, wherein one of said storage compartments is of ring-shaped cross section.

15. The convertible storage unit according to claim 14, wherein said divider means further defines a storage compartment within said base.

16. The convertible storage unit according to claim 14, wherein one of said storage compartments is cylindrical.

* * * * *